US008517187B1

(12) United States Patent
Westphal et al.

(10) Patent No.: US 8,517,187 B1
(45) Date of Patent: Aug. 27, 2013

(54) SANITARY TOOTHBRUSH HOLDER

(76) Inventors: George Westphal, Pearl River, NY (US); Alan Rosenfeld, Upper Grandview, NY (US)

( * ) Notice: Subject to any disclaimer, the term of this patent is extended or adjusted under 35 U.S.C. 154(b) by 0 days.

(21) Appl. No.: 13/401,407

(22) Filed: Feb. 21, 2012

Related U.S. Application Data

(60) Provisional application No. 61/472,343, filed on Apr. 6, 2011.

(51) Int. Cl.
*A47B 81/02* (2006.01)

(52) U.S. Cl.
USPC ..... 211/65; 248/110

(58) Field of Classification Search
USPC ..... 211/60.1, 65, 66, 69, 69.1, 69.9, 211/70.2–70.7; 248/110, 113; 206/362.3, 206/361
See application file for complete search history.

(56) References Cited

U.S. PATENT DOCUMENTS 374,794 A * 12/1887 Kilmer ..... 211/65
662,824 A * 11/1900 Rosher ..... 211/69.9
952,593 A * 3/1910 Wagner ..... 211/69.9
1,551,434 A * 8/1925 Shiffer ..... 211/65
2,169,722 A * 8/1939 Currie ..... 211/65
2,472,058 A 6/1949 Artley
3,138,414 A 6/1964 Pollo
4,854,457 A * 8/1989 Perler ..... 211/65
5,086,916 A 2/1992 Gray
D413,747 S 9/1999 Devens
5,975,314 A * 11/1999 Lee ..... 211/13.1
D497,537 S * 10/2004 O'Keene et al. ..... D8/355
7,972,100 B2 * 7/2011 Horvath et al. ..... 411/400
8,231,015 B2 * 7/2012 McCain ..... 211/74

* cited by examiner

*Primary Examiner* — Korie H Chan
(74) *Attorney, Agent, or Firm* — W. Patrick Quast

(57) ABSTRACT

A sanitary toothbrush holder is disclosed. In place of traditional vertical toothbrush placement one or more toothbrushes can be secured on two oppositely positioned drying rack arms extending forward of the base of an upright rear panel of the holder. Pairs of alternating in depth slots along the length of each one of the drying arms permits an operator to position at least one toothbrush within at least one pair of slots at an angle to the horizontal for enhanced moisture drainage therefrom, with the alternating slot arrangement preventing bristle portion cross contamination when two or more toothbrushes are secured on the holder. Provisions are also provided for a toiletry shelf, and removable wall mounting of the holder.

8 Claims, 3 Drawing Sheets

SANITARY TOOTHBRUSH HOLDER

This application claims the benefit of U.S. Provisional Application No. 61/472,343 filed on Apr. 6, 2011. This invention relates to conveniently securing one or more toothbrushes in a hygienic manner, and more particularly to a device and method for insuring maximum drainage of moisture from a toothbrush, after use, when secured thereto.

BACKGROUND OF THE INVENTION

Few actions are as ubiquitous as using a toothbrush in every day living experience. A myriad number of holders and techniques have been devised over time to add convenience to this routine daily procedure. For example, in U.S. Pat. No. 2,472,058 a Tube And Instrument Holder is disclosed. A shelf 10 (FIG. 1) supports a vertical base plate 11 having an outwardly curved portion 12 (FIG. 2) for securing a tube of toothpaste 14 (FIG. 1). Two strap members 15 and 16 (FIG. 3) connect to this base plate, extending below and then outwardly so as to form a horizontal platform for securing a toothbrush 18 (FIG. 1).

Further, in U.S. Pat. No. 3,138,414 a Sanitary Rack For Toothbrushes And Dentifrice is disclosed. In this invention one or more toothbrushes 20 (FIG. 1) are supported in a vertical position secured to a clip 28 (FIG. 5) which in turn is secured in a front positioned notch 18 (FIG. 3) within the sanitary rack 12 (FIG. 3). Each toothbrush head portion is enclosed in a separate box 36 (FIG. 3). The rack also provides means for holding toothpaste tubes, drinking glasses, soap dish, etc.

Again, in U.S. Pat. No. 4,854,457 a Hygienic Toothbrush Holder is disclosed. The teachings here describe a toothbrush holder 10 (FIG. 1) serving two or more toothbrushes 44, 46, etc. (FIG. 5) in a staggered horizontal position making use of holding clips 34, 36, etc. (FIG. 5).

U.S. Pat. No. 5,086,916 teaches a Toothbrush Sterilization Container And Mounting Bracket. In this disclosure one or more toothbrushes 14 (FIG. 2) are secured in a container 10 (FIG. 1). The toothbrush is placed vertically in the container, brush end down, with the brush end of the toothbrush immersed in an antiseptic agent 12 (FIG. 2). Means are provided for conveniently securing a tube of toothpaste 80 (FIG. 1).

Again, in U.S. Pat. No. Des. 413,747 A Toothbrush Holder is depicted. A pair of vertical arms is shown with outwardly curved base portions securing a toothbrush placed horizontally across the two curved base portions.

While the above noted devices and methods for securing one or more toothbrushes denote many useful approaches for these daily toiletry procedures, they do not envisage the economy, simplicity, and improved functional utility of the present invention.

Therefore it is a primary object of the present invention to provide a sanitary toothbrush holder.

A further object is to provide more efficient fluid drainage of a toothbrush after use.

Still another object is to prevent possible bacterial cross contamination between two or more toothbrushes positioned on the same toothbrush holder.

Yet another object is to provide a convenient, sanitary holder for at least one toothbrush and at least one tube of toothpaste.

An additional object is to provide a wall mounted sanitary toothbrush holder.

A further object is to provide a convenient wall mount for quick connection and disconnection of a sanitary toothbrush holder.

SUMMARY OF THE INVENTION

These and other objects are obtained with the sanitary toothbrush holder of the present invention.

To the inventive mind many daily activities clamor for improvement. This is certainly the case in a typical bathroom, and is surely the case when dealing with a toothbrush. The usual vertical placement of a toothbrush holder seemingly ignores basic hygiene and simple physical principles. Little attention is paid to gravity or possible cross contamination.

It occurred that relatively simple modifications of a standard toothbrush holder could significantly improve the function and convenience in use of this common bathroom fixture. To this end a sanitary toothbrush holder of the present invention is designed. Basically, the holder is comprised of a generally rectangularly shaped upright rear panel having two oppositely positioned arms connected to, and extending forward of, the base of the rear panel. These two arms serve as a convenient holder and drying rack for one or more toothbrushes.

Each arm has at least one slot notched into its top surface for securing a toothbrush thereto. The two slots are positioned directly opposite one another so as to form a toothbrush holder pair. It is the essence of the present invention that a first one of said pair of slots have a deeper notch in comparison to its oppositely positioned second slot so that when a toothbrush is placed within the pair of slots the toothbrush is held at an angle to the horizontal, so that any retained water in the brush portion of the toothbrush drains therefrom.

Obviously, additional pairs of slots can be incorporated into each arm for securing two or more toothbrushes on the same drying rack. Although not required, it is preferred that each first or second slot in each subsequent pair of slots then alternate in slot depth so that when two or more toothbrushes are secured upon the drying rack, each toothbrush may be positioned by a user for maximum efficient drainage, while juxtaposed in relation to one or more toothbrushes so as to prevent accidental cross contamination from one toothbrush bristle portion to another toothbrush bristle portion. It is also further envisioned that the higher notched slot of each pair of slots have a wider width than its companion lower notched slot so as to more readily accommodate the handle portion of a toothbrush.

The rear panel may also accommodate a forwardly projecting front shelf extending along its width, and being positioned above the arms of the drying rack below. This front shelf can be used, for example, for securing a tube of toothpaste.

The above described sanitary toothbrush holder may be employed as a stand alone device, or more typically be mounted directly on a wall using adhesives, screw mounts, or other mounting techniques. Alternatively, the holder can be removably secured to a wall mount, with said wall mount being screw mounted to a wall, or alternatively being secured with a pair of optional adhesive backed wall mount securing blocks. For quick connection and disconnection of the holder the wall mount can be equipped with a pair of top and bottom peg extensions, with the holder having top and bottom peg extension receptacle depressions matching the peg extensions in complementing relationship.

Ideally the sanitary toothbrush holder can be fabricated in a glazed ceramic material. Various rigid or semi-rigid plastics or even metals can also be employed depending on economic considerations and designer choice.

DETAILED DESCRIPTION OF THE PREFERRED EMBODIMENTS

Figure 1:
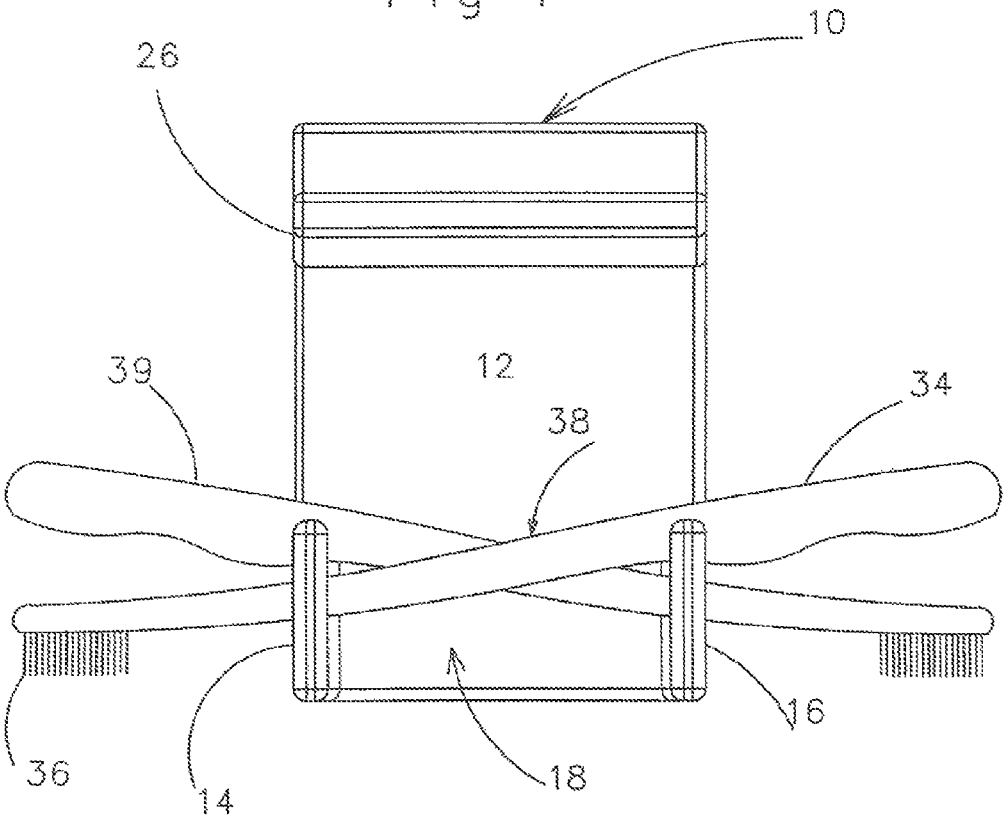
FIG. 1 is a front, elevation view of one version of the sanitary toothbrush holder of the invention, depicting two toothbrushes angularly secured to the drying rack portion of the holder.

Turning now to the drawings wherein similar structures having the same function are denoted with the same numerals, in FIG. 1 a version of the sanitary toothbrush holder of the invention is shown. In this view the holder 10 is shown securing two toothbrushes 38 and 39 positioned on forward extending drying rack arms 14, 16. Each toothbrush is positioned at an angle to the horizontal so that the handle portion 34 is elevated in relation to its bristle portion 36 in order to enhance moisture drainage therefrom. Also preferred is the fact that each bristle portion 36 is juxtaposed with a handle portion 34 so as to virtually eliminate possible cross contamination between drying bristle portions.

Figure 2:
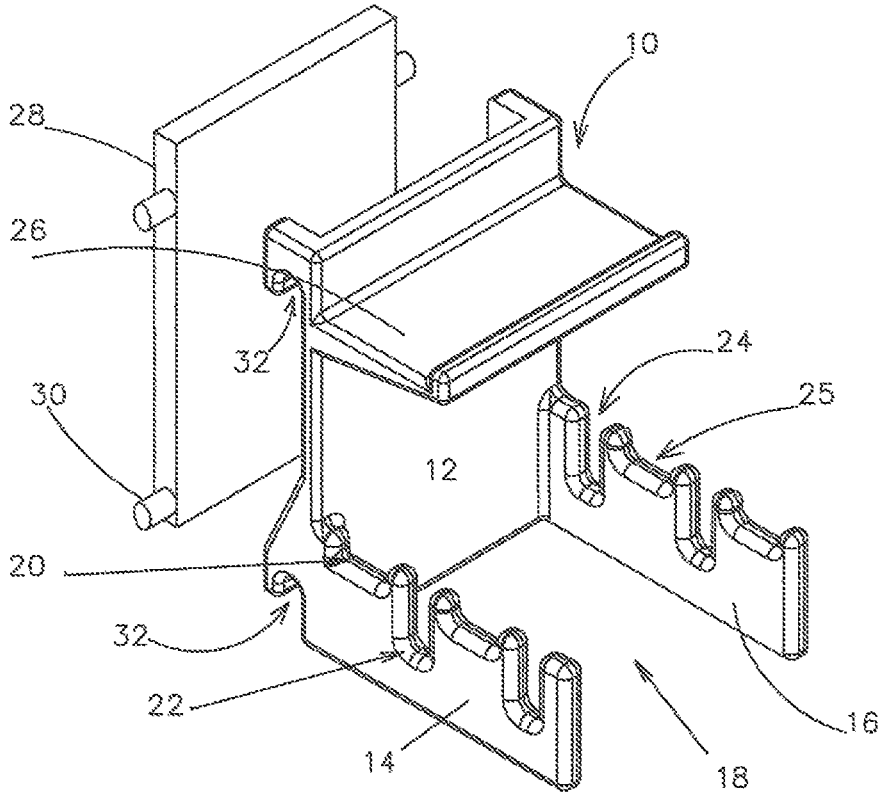
FIG. 2 is an exploded, perspective view of one version of the sanitary toothbrush holder and wall mount of the invention.

FIG. 2 illustrates one version of the sanitary toothbrush holder 10 shown disconnected from a wall mount 28. This detailed view of left drying rack arm 14 and right drying rack arm 16 clearly depicts the unique aspect of the present invention. The drying rack arms 14, 16 are shown connected to the base of the holder rear panel 12, extending forward of the rear panel in a parallel relationship to each other, with a spaced distance 18 in between. Slots such as 20, 22 along the length of left drying arm 14 and slots 24, 25 along the length of right drying arm 16 provide the means for securing one or more toothbrushes. As clearly seen slot 20 is set higher than slot 22, and so on, along the left drying arm 14, with an opposite arrangement of slot depth along the length of the right drying arm 16, e.g. 24 then 25. This configuration insures, as best seen in FIG. 1, that when an operator positions a toothbrush with its handle portion at a higher elevation in regards to its bristle portion, enhanced moisture drainage is assured. And in addition, the alternate positioning in regards to slot depth along the length of each drying arm virtually prevents accidental cross contamination between toothbrush bristle portions. A further feature of the invention is the wider dimensions of the elevated slot 20 and 25 for greater accommodation in operator placement of a toothbrush handle 34.

FIG. 2 illustrates other features that can be incorporated into the sanitary toothbrush holder. A shelf 26 is shown connected to the rear panel, extending a spaced distance forward and above the drying rack arms. This shelf can be used for a variety of toiletries, as, for example, a tube of toothpaste (not shown). Also depicted are peg extension receptacle depressions 32 at the top and base of the holder rear panel 12 which will be more fully discussed below.

Figure 3:
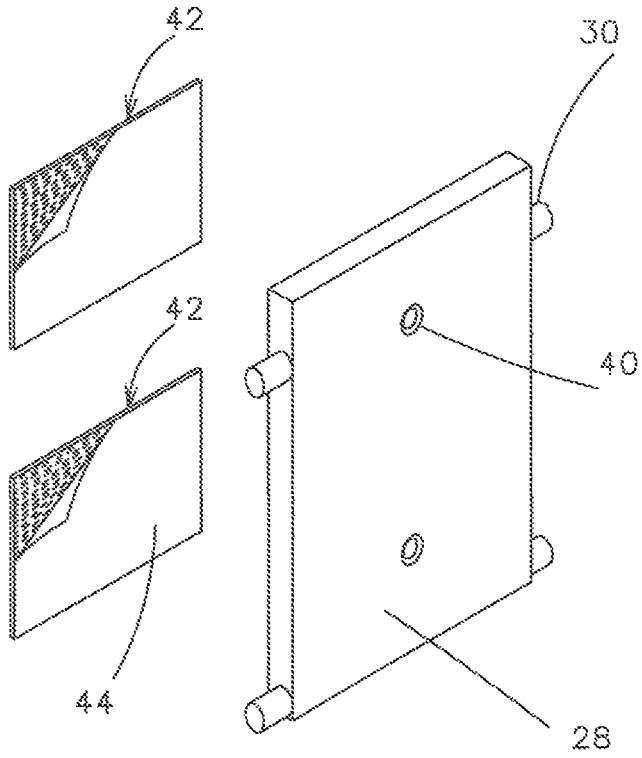
FIG. 3 is a front, exploded perspective view of one version of a wall mount for the sanitary toothbrush holder prior to being secured to a wall via a pair of double adhesive backed wall mount securing blocks.

In FIG. 3 a possible wall mount 28 for the sanitary toothbrush holder is depicted. The holder 10 of FIGS. 1 and 2 can be directly affixed to a wall (not shown) if required. However, a quick connect/disconnect for cleaning purposes would be a desirable feature. The wall mount 28 can be affixed to a wall using screws (not shown) via screw receptacles 40. Alternatively, one or more double adhesive backed wall mount securing blocks 42 can be employed. With the blocks 42 in place, simply removing a peel-away adhesive backing 44 provides for convenient securing of the wall mount. Peg extensions 30 on both left and right sides of the wall mount adjacent its top portion and base portion provide for quick connection and disconnection of the holder via the holder's matching peg extension receptacle depressions 32 when required.

Typical dimensions for the sanitary toothbrush holder 10 can be, for example, a rear panel 12 measuring 6" H×4"W. The left drying rack arm 14 and the right drying rack arm 16 can extend approximately 4" forward of the base of the rear panel, with approximately 2½" of space 18 between them. The upper toothpaste tube shelf 26 can extend approximately 2" forward of the holder rear panel. The wall mount can be dimensioned similar to the holder, as, for example, 6"H×2½" W, with its top and bottom peg extensions 30 effectively extending the width of the wall mount 28 to approximately 4".

Thus it can be seen that the sanitary toothbrush holder of the present invention provides a functionally new and economic convenience to this routinely ignored daily procedure. One or more toothbrushes are now plainly in view and quickly accessible, with user assurance that each toothbrush is in a dry condition and maintained in a clearly sanitary state.

While the present invention has been disclosed in connection with versions shown in detail, various modifications and improvements will become readily apparent to those skilled in the art. Accordingly, the spirit and scope of the present invention is to be limited only by the following claims.

What is claimed is:

1. A sanitary toothbrush holder for holding at least one toothbrush while not in use, said tooth brush having a handle portion and a brush portion including a bristle portion, said handle portion including a grip segment having a respective contour and a further segment having a respective contour, in close proximity to the brush portion, comprising:

(a) a toothbrush drying rack for securing at least a first toothbrush;

(b) said rack having a top portion, a base portion, a left side and a right side;

(c) said base portion of said rack having a left arm and a right arm extending along a respective longitudinal axis a spaced distance forward of said base portion, said left arm being positioned adjacent said left side of said rack, and said right arm being positioned adjacent said right side of said rack, said left arm and said right arm being positioned substantially parallel to each other;

(d) said left arm and said right arm having means for securing at least the first toothbrush;

(e) said toothbrush securing means being comprised of at least one slot in a top surface of both said left arm and said right arm, each one of said slots being directly opposite one another in said left arm and said right arm so as to form a pair of slots for securing a toothbrush, a first slot of each one of said pair of slots having a deeper cut in comparison to a cut forming the oppositely positioned second slot of said pair of slots, whereby the toothbrush when in place on the holder pivots downward from a point of contact in said second slot such that the toothbrush is held at an acute angle to the horizontal, and wherein at least one of said first slot or said second slot has a contour at least in the direction of the longitudinal axis of the arm in which it is formed, said contour, at least in part, the complement to the respective contour of the respective one of said grip segment or said further segment such that a cooperative interaction between said contour of at least one of said first or second slot and the complementing respective contour of the respective one of said grip segment or said further segment results such that the toothbrush is retained in a stable, non-rotational manner with the bristle portion of the brush portion held in a vertical plane parallel to a plane containing said base portion, so that the drainage of any retained water in the brush portion of the toothbrush is facilitated; wherein there is at least two pairs of first and second slots, said first or second slots in each subsequent pair of slots then alternating in slot depth so that when two or more toothbrushes are secured upon said rack, each toothbrush may be operator positioned with its handle portion positioned at a higher elevation in reference to its brush portion, said toothbrushes being positioned for maximum efficient drainage, while juxtaposed in relation to one or more additional toothbrushes so as to prevent accidental cross contamination from one toothbrush bristle portion to another toothbrush bristle portion.

2. The sanitary toothbrush holder claimed in claim 1 wherein said holder is fabricated in glazed ceramic.

3. The sanitary toothbrush holder claimed in claim 1 wherein said second slot of said pair of slots is wider in width than said first slot of said pair of slots so as to more readily accommodate the handle portion of said toothbrush.

4. The sanitary toothbrush holder claimed in claim 1 further comprising a shelf connected to said toothbrush drying rack, said shelf being positioned a spaced distance below said top portion of said rack on a front portion of said rack, said shelf extending a spaced distance forward of said top portion of said rack and above said right and left arms of said rack.

5. The sanitary toothbrush holder claimed in claim 1 further comprising means for securing said holder to a wall.

6. The sanitary toothbrush holder claimed in claim 5 wherein said wall securing means further includes a wall mount providing quick connection/disconnection of said holder from said wall, said wall mount being separate from said holder, said wall mount comprising a top and bottom portion, a left and right side and a front and rear panel, said wall mount having a pair of oppositely positioned peg extensions on both said left and right sides of said wall mount adjacent both top and bottom portions, said wall mount peg extensions matching cooperating peg extension receptacle depressions within said top portion and said base portion of said toothbrush drying rack, so that when said wall mount is affixed to said wall an operator can quickly connect or disconnect said holder from said wall mount making use of said peg extension receptacle depressions in said rack and said peg extensions on said wall mount.

7. The sanitary toothbrush holder claimed in claim 6 wherein said wall mount is affixed to said wall making use of screw receptacles extending through said front and rear panels of said wall mount.

8. The sanitary toothbrush holder claimed in claim 6 wherein said wall mount is affixed to said wall utilizing one or more double adhesive backed wall mount securing blocks, so that when one or more of said blocks is adhesively secured to said wall an operator can adhesively secure said wall mount to said wall by pressing said rear panel of said wall mount against an open face of one or more of said blocks.

* * * * *